United States Patent [19]

Keithley et al.

[11] 4,185,556

[45] Jan. 29, 1980

[54] MINE FIRING SYSTEM

[75] Inventors: Joseph F. Keithley, Washington, D.C.; Matthew L. Sands, Santa Fe, N. Mex.

[73] Assignee: The United States of America as represented by the Secretary of the Navy, Washington, D.C.

[21] Appl. No.: 597,930

[22] Filed: Jun. 6, 1945

[51] Int. Cl.[2] ..... F42B 22/04

[52] U.S. Cl. ..... 102/18 M

[58] Field of Search ..... 102/7, 16, 18

[56] References Cited

U.S. PATENT DOCUMENTS 1,382,374 6/1921 Maxim ..... 102/18

FOREIGN PATENT DOCUMENTS 29013 1/1925 France ..... 102/18

*Primary Examiner*—Charles T. Jordan

*Attorney, Agent, or Firm*—R. S. Sciascia; A. L. Branning

EXEMPLARY CLAIM

1. In a submarine mine, a normally open mine firing circuit, a timing device operable in unit cycles and having means for closing said firing circuit partially during a cycle of operations thereof, and pressure and magnetic responsive means each of which is adapted to either initiate a cycle of operations of said timing device or to complete said firing circuit during a cycle of operations of the timing device selectively in accordance with the sequence of response of said pressure and magnetic means.

16 Claims, 8 Drawing Figures

MINE FIRING SYSTEM

This invention relates to influence firing control systems for marine mines and more specifically to a mine firing control system operable on the combined effects of a change in the earth's magnetic field and a change in the pressure field adjacent the mine produced in predetermined time spaced relation by a vessel moving with respect thereto, and in which the primary object is to provide a system wherein the possibility of prematurely detonating the mine through the medium of sweeping apparatus is extremely remote.

Another object is to provide new and improved means for arming a mine in response to a change in a first physical variable and for firing the mine in response to a change in second physical variable or arming the mine in response to a change in the second physical variable and firing the mine in response to a change in the first physical variable, selectively in accordance with the physical quantity initially varied.

Another object is the provision of a new and improved mine firing control system which is adapted to become armed for a predetermined interval in response to a first signal and to be fired if a second signal is received during the first predetermined interval and in which means are provided for restoring the system to an initial condition in the event a second signal is not received during the predetermined interval.

Another object of the invention is to provide a mine firing control system of the type hereinabove disclosed in which the sensitivity of the system is automatically adjusted in accordance with the depth of submergence of the mine.

Another object is to provide within a mine of the type heretofore disclosed a new and improved hydraulic circuit adapted to respond to changes in the pressure field adjacent the mine.

A further object is to provide a new and improved hydraulic system responsive to pressure changes and in which means are provided for eliminating certain operational difficulties imposed thereon by the orientation of the system in space.

A still further object lies in the provision of means for substantially filtering out the effects of tides and waves upon the firing mechanism of a pressure controlled marine mine.

Still another object is the provision of a new and improved mine firing control system wherein the system operates to detonate and explode the mine associated therewith a response to the movement of a surface vessel within the zone of destructivity of the mine.

The aforesaid objects are accomplished in the system of the present invention which, in its broader aspects, comprises two components, a pressure component and a magnetic component which when set in operation under prescribed conditions mutually coact to produce a firing actuation of the system. The pressure component operates on a principle well known as Bernoulli's theorem which states that an increase in the rate of flow of a fluid is accompanied by a reduction in the pressure thereof. The applicability of Bernoulli's theorem to the operation of the pressure component lies in the fact that a surface vessel moving through a body of water produces a rapid flow of water beneath the vessel, thereby lowering the pressure thereunder. Accordingly, the pressure component is adapted to operate on the region of negative pressure in the pressure field of a vessel moving in the water adjacent a mine within which the system of the present invention is employed.

The particular functions of the pressure component or hydraulic circuit of the present invention are to filter out slow changes in pressure produced in the pressure field adjacent the mine by tidal action and to transmit rapid changes in pressure caused by the passage of a vessel over the mine directly to a pressure sensitive element notwithstanding the depth of submergence or the orientation of the mine in space. The pressure sensitive element measures the pressure difference between the two sides of a bulkhead, hereinafter referred to as a base plate, which is located in the hydraulic circuit.

In the event that the pressure difference between the two sides of the base plate reaches at least a predetermined value, the pressure sensitive element operates to cause energization of a control circuit comprising a portion of an electrical circuit included in the system of the present invention. If the pressure sensitive element is maintained in operation for a predetermined interval, operation of a timing means is initiated by the control circuit, thereby to arm the mine for a prescribed period of time, hereinafter referred to as the live period.

The magnetic component of the system of the instant invention is one well known in the art to which the invention appertains and comprises means suitable for detecting changes in the earth's magnetic field adjacent the mine produced by the passage of a vessel over or near the mine and for generating an electro-motive force in accordance therewith. A sensitive relay is operatively connected to the detecting means and is adapted to be operated thereby in response to an electro-motive force of a predetermined value. In the event the relay is caused to operate during the live period of the mine, a circuit is closed thereby to an electro-responsive detonator, thus firing the mine. If, however, a magnetic signal of sufficient strength to operate the relay is not received during the live period, the system is restored to normal without firing the mine.

Whereas in the foregoing discussion it was disclosed that the mine becomes armed in response to a pressure signal and is fired by a magnetic signal, it will be understood that a magnetic signal may place the mine in an armed condition for said prescribed period of time, the mine being fired thereafter in response to a pressure signal received during the interval, such characteristic of operation becoming more clearly apparent as the description proceeds.

For a more complete understanding of a preferred embodiment of the invention and the operation thereof, reference is made to the following description taken in connection with the accompanying drawings in which.

Figure 1:
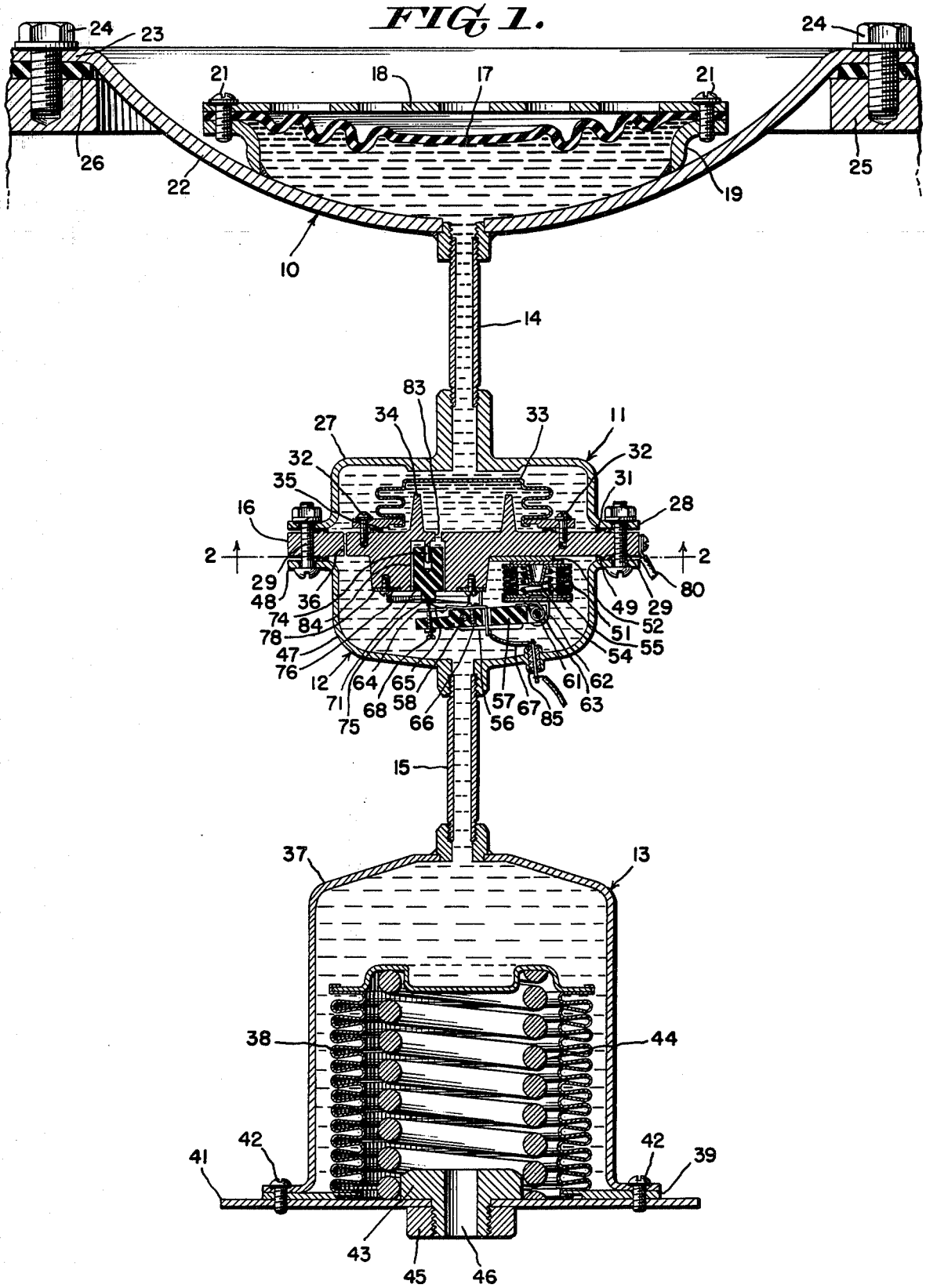
FIG. 1 is a schematic view in section of the hydraulic system of the instant invention.
Figure 2:
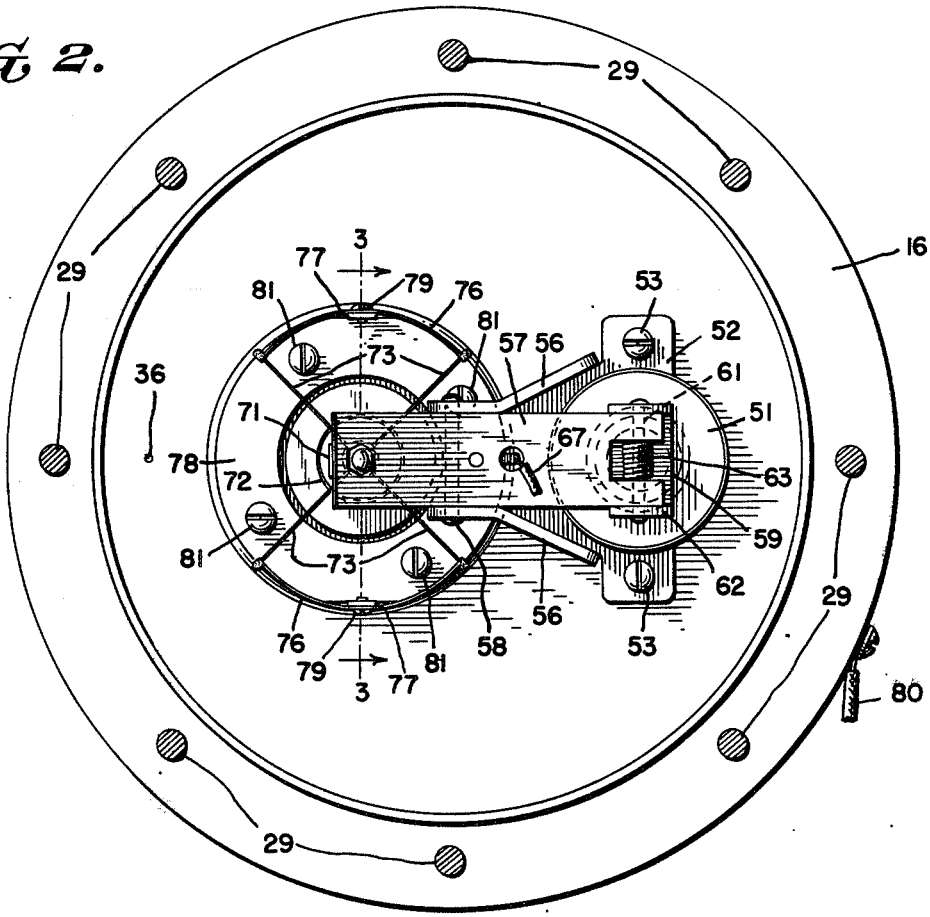
FIG. 2 is an enlarged view taken substantially along the line 2—2 of FIG. 1.
Figure 3:
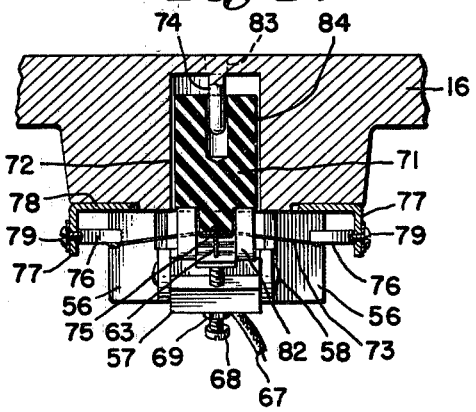
FIG. 3 is a fragmentary view taken substantially along the line 3—3 of FIG. 2.
Figure 4:
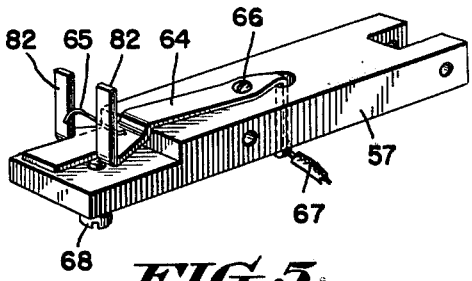
FIG. 4 is a detailed perspective view of the pivoted arm associated with the automatic depth adjusting bellows.
Figure 5:
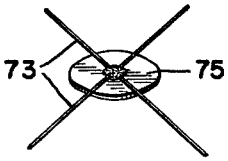
FIG. 5 is a detailed perspective view of one portion of an electrical contact and the means for securing said portion to suitable suspension means.

Referring now to FIGS. 1 through 5 inclusive, there is shown thereon a hydraulic system comprising 4 chambers, 10, 11, 12 and 13. The chambers 10 and 11 are interconnected by means of a tubular member 14 and the chambers 12 and 13 are interconnected by means of another tubular member 15. The chambers 11 and 12 are substantially separated from each other by the provision of a metallic base plate 16. The chamber 10 is separated from the water by a flexible diaphragm 17 composed of any suitable material such, for example, as Neoprene mounted between a perforated guard plate 18 and a flanged ring 19 by means of the screws 21. The flanged ring 19 is secured, as by welding, to a disk-shaped cover 22, which cover has a flanged periphery 23 drilled to receive the screws 24, thereby securing the cover to the mine case 25 which may be of any type adapted to enclose the main charge of the mine and the other components thereof in the usual manner. A gasket 26 is disposed between the flanged periphery 23 and the mine case 25 in order to insure a watertight joint therebetween.

The chamber 11 comprises a cup-shaped member 27 having a flanged portion 28 through which the bolts 29 extend whereby the cup-shaped member 27 is fastened to the base plate 16. A fluid-tight connection is insured between the member 27 and the base plate 16 by the provision of a suitable gasket 31 therebetween. Arranged within the chamber 11 and mounted on the base plate 16 by means of the screws 32 is a bellows assembly 33. Interposed between the bellows assembly 33 and base plate 16 is suitable gasket means 35 for insuring a fluid tight connection therebetween. The base plate 16 is provided with a circular upright portion 34 which is adapted to limit the downward movement of the bellows assembly 33 and to provide a fluid tight seal when the bellows is in engagement with the portion 34. The base plate is also provided with a metered opening or orifice 36 hereinafter referred to as an equalizing leak which allows fluid from the chambers 10 and 11, hereinafter referred to as the front volume, to communicate with that of the chambers 12 and 13, hereinafter referred to as the back volume.

The chamber 13, which contains a portion of the back volume, comprises a cylindrical member 37 within which is arranged a metallic bellows assembly 38 having a mounting ring 39 secured thereto. The cylindrical member 37 and bellows assembly 38 are clamped to a mounting plate 41 by means of the screws 42 in such a manner as to prevent fluid from leaking therethrough. The mounting plate 41 is provided with a hole through which extends a threaded portion of a spring centering device 43 which acts upon the supporting spring 44 of the bellows 38. The threaded portion of the centering device 43 is adapted to receive a nut 45 by means of which the device is securely clamped to the mounting plate 41. The centering device is provided with a bore 46 which allows free passage of air between the interior of the bellows 38 and the mine case 25. It will be noted at this point that the bellows 38 also separates the back volume from the air contained in the amine case.

The chamber 12, which contains a portion of the back volume, comprises a cup-shaped member 47 having a flanged portion 48 through which the bolts 29 extend whereby the member 47 is fastened to the base plate 16. A fluid tight connection is insured between the member 47 and the base plate 16 by the provision of suitable gasket means 49 therebetween. Arranged within the chamber 12 is an air filled, spring supported bellows 51 which is mounted on a supporting member 52, the member 52 being secured to the base plate 16 by means of the screws 53. Formed within the bellows 51 is a depending portion 54 which is adapted to limit the movement of the bellows 51 and to center the supporting spring 55 thereof.

Integral with the supporting member 52 are two upright portions 56 to which the arm 57, composed of any suitable insulating material, is pivoted by means of the pin 58, one end of the arm 57 being pivotally secured to a mounting plate 59 by a pin 61 which extends through the ears 62 of the plate 59, the plate 59 being secured to the free end of bellows 51 in any suitable manner. In order to prevent backlash of the arm 57, a coil spring 63 is provided around the pin 61 in a well known manner. An adjustable mounting strip 64 carrying an electrical contact member 65 is secured to the arm 57 by means of the screw 66, one end of the mounting strip being extended through a hole in the arm to which a flexible lead 67 is attached. It will be noted that the lead 67 is brought to the exterior of the chamber 12 by means of a fluid tight insulator 85. An adjusting screw 68 with a locking nut 69 mounted thereon extends through an internally threaded bore in the arm 57 and into engagement with the strip 64.

A cylindrical float 71 is supported concentrically at one end in a cylindrical bore 72 in the base plate 16 by the crosswires 73, lateral support therefor being provided at the other end by a pin 74 having a triangular cross-section. At the intersection of the cross wires, a small disc 75 of a suitable conducting material such, for example, as platinum is soldered, thereby forming one contact of an electrical switch, the other contact of the switch being the adjustable contact 65. The ends of the cross wires 73 are soldered to two bowed spring members 76, which spring members are secured to the ears 77 of a supporting ring 78 by the screws 79, the supporting ring in turn being securely fastened to an enlarged portion of the base plate 16 by the screws 81. The cross wires 73 and the disc 75 are cemented to the float 71 whereby the spring tension applied to the float allows free oscillation thereof within bore 72. The strip 64 has two stop fingers 82 thereon adapted to limit the downward movement of the float. It will be noted that contacts 65 and 75 are normally held in engagement with each other by reason of the spring tension exerted on the cross wires by the members 76 and that an electrical circuit is provided from the lead 80 through the base plate, supporting ring 78, spring members 76, and cross wires 73 to the disc 75. It is of importance to note further that the float 71 is a plastic of such a density that the assembly comprising the float, disc and cross wires has the same specific gravity as the fluid whereby the sensitivity of the contacts 65 and 75 is not affected by the orientation of the assembly in space. Moreover, the fluid employed herein is of a type such, for example, as Dow Corning fluid which has a substantially uniform viscosity over a wide temperature range.

At one end of the bore 72 is a plurality of small openings or orifices 83 of sufficient size to allow fluid to pass in either direction between the bellows 33, hereinafter referred to as the middle volume, and the back volume.

The fluid passes through the metered clearance 84 between the float and the walls of bore 72, such clearance being referred to hereinafter as the float leak.

Figure 6:
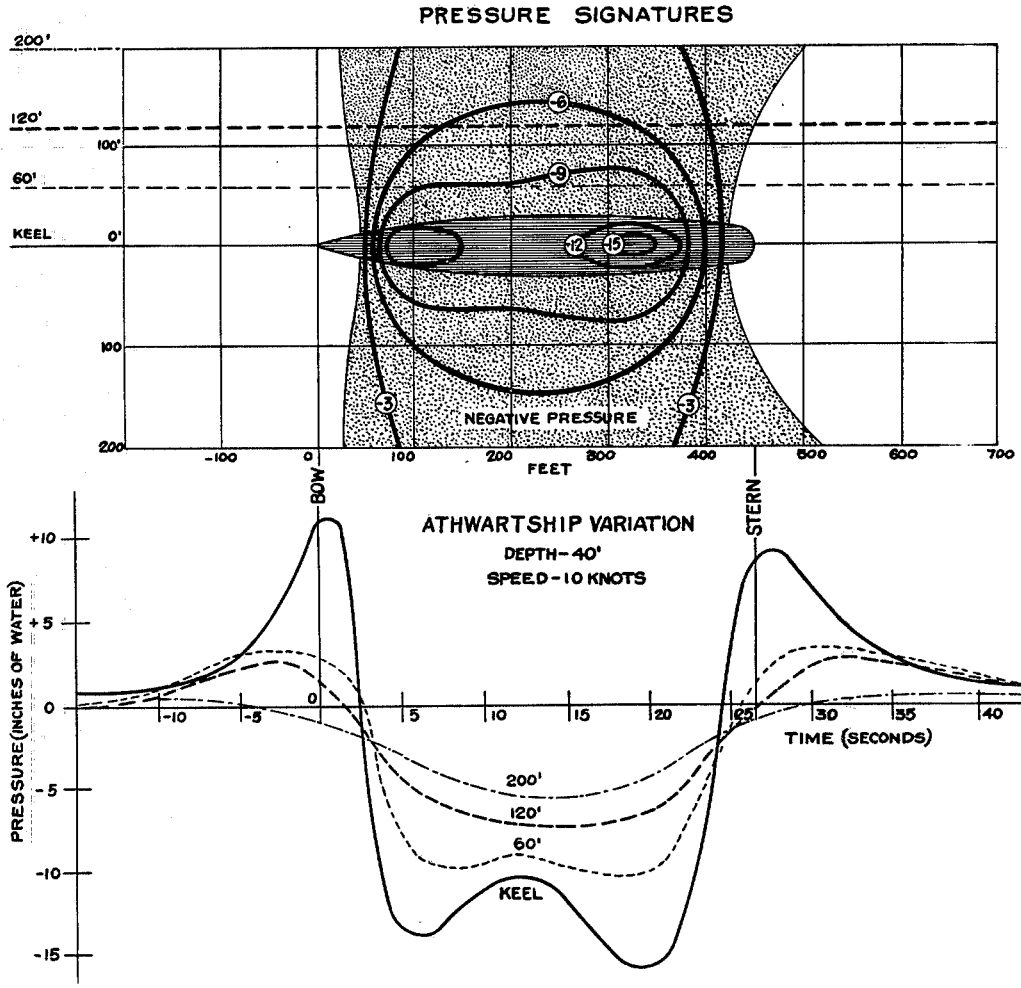
FIG. 6 is a diagrammatic view showing the pressure contour and signatures of a vessel moving in a body of water.

FIG. 6 of the drawings shows a contour map of the pressure field on the bed of a body of water as a vessel passes thereover and the pressure signature of the vessel as received by a system of the character herein disclosed when a mine comprising the system is submerged to a depth of forty feet. As heretofore described in connection with Bernoulli's principle, a region of negative pressure exists beneath a vessel moving through the water, the negative pressure area being stippled in FIG. 6. The negative pressure region, as measured in inches of water, extends several beams athwartship but decreases progressively as the distance athwartship is increased. The heavy lines designated -3, -6, -9, etc. illustrate the negative pressure in inches at various points in the field. The ship pressure signature shown in solid outline in FIG. 6 corresponds to a signature received by the system hereindisclosed when the mine rests at a point directly below the keel of the vessel, while the signatures shown in dashed outline correspond to points at various distances athwartship. Thus, it is obvious from these signatures that a system placed directly beneath the keel experiences greater reductions in pressure than a system placed some distance athwartship. Moreover, it may be said that generally the pattern of the pressure signature of a vessel remains unchanged as the vessel moves, provided the depth remains unchanged. When the depth changes, the general pattern remains the same but the magnitude of the pressures involved changes, the pressures varying substantially inversely as the square of the depth. When the speed changes, the essential nature of the pattern remains unchanged but for lower speeds the magnitude of the pressures involved are directly proportioned to the square of the speed.

Figure 7:
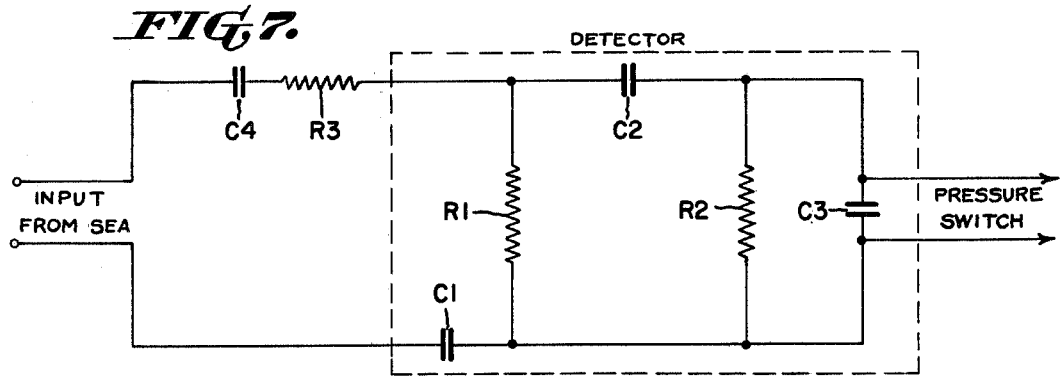
FIG. 7 is a diagrammatic view showing an electrical circuit analogous to the hydraulic system of the present invention; and, FIG. 8 shows in diagrammatic form an electrical system for a mine suitable for use with the hydraulic system of FIG. 1.

The component parts of the hydraulic system housed in the chambers 11 and 12, FIG. 1, will hereinafter be referred to cumulatively as the detector mechanism. As is well known, a bellows assembly has most of the properties of a spring, a linear relation existing between the volume displaced thereby and the pressure applied thereto whereby the bellows behaves in a manner similar to a condenser. In addition, an orifice is analogous to electrical resistance. Applying this system of analogy to the hydraulic system of the present invention yields the circuit shown in FIG. 7 wherein R1 is the resistance of orifice or equalizing leak 36, R2 is the resistance of the float leak 84, C1 is the compliance of the reference bellows 38, C2 is the compliance of the bellows 33, and C3 is the compliance due to the motion of the float 71. R3 and C4 are the resistance of the connecting tubing 14 and capacity due to the stiffness of diaphragm 17, respectively. This circuit is immmediately recognizable as a two section, high pass RC filter. By selecting certain values for R1, R2, C1, C2 and C3 it is possible to effectively attenuate tidal action, as will more clearly appear as the description proceeds.

With further reference to FIGS. 1 through 5 inclusive of the drawings, a brief description of the operation of the pressure component per se will be given. Primarily, the position of the adjustable contact 65 as it presses against the float contact 75 is determined by the setting of the adjusting screw 68 and thereby determines the tension in the cross wires 73 and ultimately the force necessary to open the contacts 65 and 75. If the adjustable contact is moved toward the float by the adjusting screw, the tension in the cross wires is increased and consequently the pressure necessary to open the switch is increased. It will be noted that the two stop fingers 82 which are adapted to limit the movement of the float 71 prevent bending of the adjustable contact 65.

Before a mine containing the hydraulic system of FIG. 1 is planted in a body of water, the pressure in the fluid in all volumes is close to atmospheric pressure. When the mine is planted, the pressure of the surrounding water immediately displaces the diaphragm 17, thereby reducing the front volume. When the front volume is reduced, such increase in pressure is communicated to the bellows 33 and causes the bellows to compress, thereby increasing the pressure in the middle volume. When this occurs, fluid from the front volume passes through the equalizing leak 36 into the back volume and fluid from the middle volume passes through the float leak 84 into the back volume, raising the pressure in the back volume and compressing the back volume bellows 38. Fluid leakage through the equalizing leak and through the float leak allows the pressure in the back volume to come to equilibrium with the front and middle volumes at a value equal to the pressure of the water surrounding the mine. This equalizing process requires a period of time dependent upon the depth of submergence of the mine.

The leakage of fluid into the back volume has also compressed the depth adjustment bellows 51, moving the adjustable contact 65 back from the float 71, thereby setting the sensitivity of the detector mechanism for the depth at which the mine is planted. The pressure component is now in condition to respond to changes in the pressure field surrounding the mine.

When the pressure of the water surrounding the mine is reduced below that prevailing after planting, the diaphragm 17 expands, thereby decreasing the pressure in the front volume and consequently the pressure exerted on bellows 33. When this occurs, the bellows 33 expands and decreases the pressure in the middle volume which results in a pressure difference between the two sides of the base plate 16, such pressure difference being exerted on the float 71 by the back volume and causing the contact 75 carried by the float to be moved out of engagement with the adjustable contact 65.

The principle involved in tidal compensation will now be described. A slow change in pressure in the front volume is followed very closely by corresponding changes in the middle and back volumes. The size of the equalizing leak 36 and the float leak 84 and the corresponding bellows volumes 33 and 38 are so chosen that the time taken for pressures on the two sides of the base plate 16 to equalize is small compared to the time taken for tidal changes which have a long period, but large compared to the time taken by the pressure changes produced by ships, such changes being of relatively short period.

Figure 8:
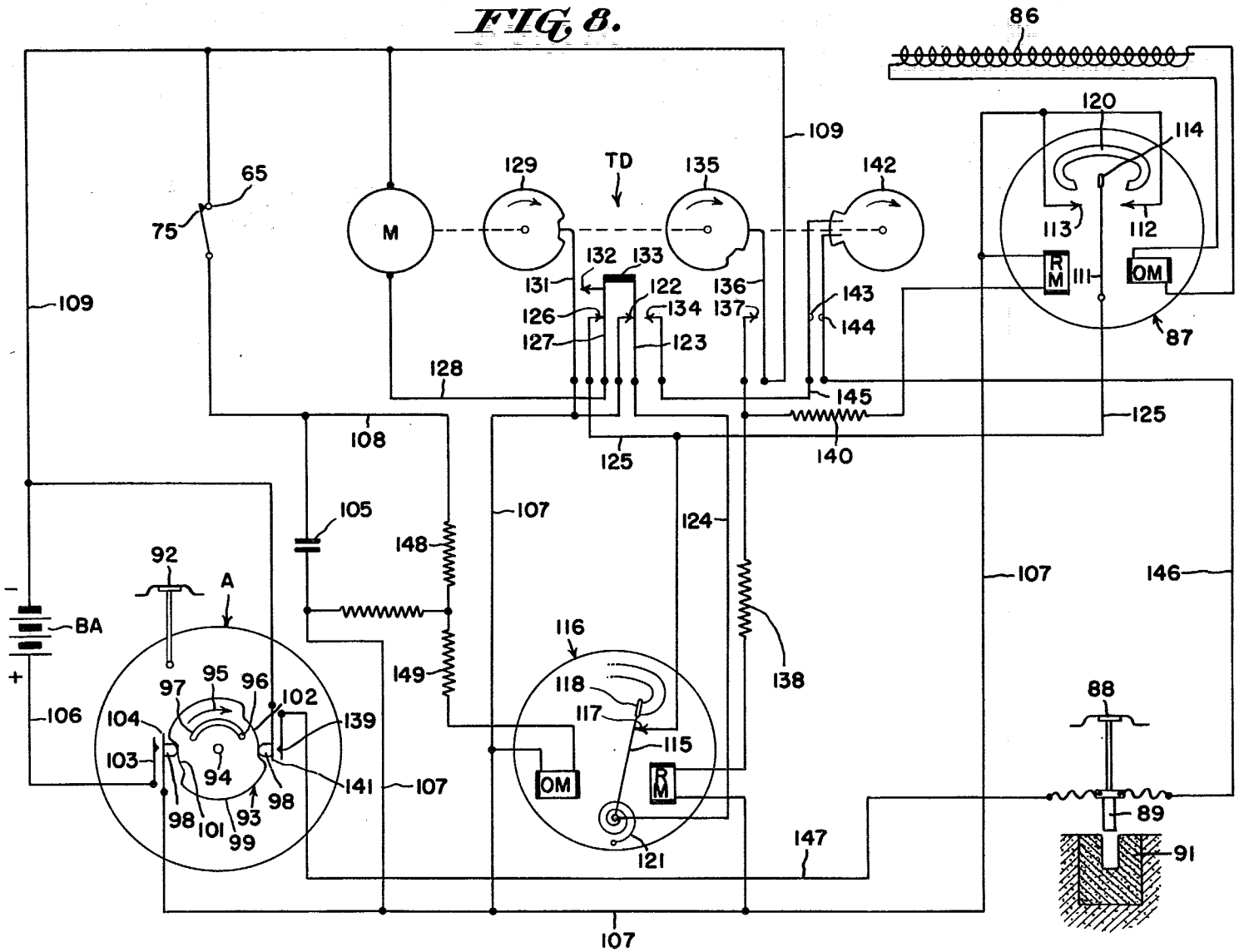

For a brief description of the magnetic component of the mine firing system herein disclosed, such component being well known in the art to which the invention appertains, reference is made to FIG. 8 of the drawings. An induction type, "Permalloy"-cored coil 86 wound with a plurality of turns of wire is employed to detect changes in either direction in the earth's magnetic field adjacent the mine. A sensitive relay 87 is operatively connected to the coil 86, hereinafter referred to as a search coil and is adapted to close a circuit in response to a predetermined change of field in either direction, such change being detected by the search coil.

FIG. 8 also shows several component devices which are essential to the safe and accurate operation of the mine, which devices will be described in more detail as the description proceeds.

For a more complete understanding of the operation of the system of the present invention, reference is again made to the electrical system shown in FIG. 8 of the drawings. Let it be assumed, for the purpose of description, that a mine containing the invention has been launched into a body of water and has come to rest on the bed thereof. Let it further be assumed that an extender mechanism 88, well known in the art, has operated and moved an electro-responsive detonator 89 associated therewith into operative relation with a booster charge 91 in a well known manner, the booster charge being adapted to explode the main charge when ignited by the detonator.

A clock mechanism A, of any type suitable for the purpose such, for example, as the clock mechanism described and claimed in the copending application of James B. Glennon et al for Firing Mechanism for a submarine mine, Ser. No. 395,230, filed May 26, 1941, is provided in the circuit and is adapted to close a plurality of circuits in predetermined sequential order and within predetermined periods of time after the mine has been launched within the water. When an interval of time has elapsed after the launching of the mine during which a salt washer comprising an element of the clock mechanism A is dissolved, a water hydrostat 92 on the mechanism is caused to operate by the pressure of the surrounding water, thereby to initiate the operation of a spring wound motor comprising another element of the clock mechanism A. When this occurs, a cam member 93, mounted for rotation on a pivot 94, is caused to rotate by the spring motor in the direction of the arrow 95 until the cam engages a stop pin 96 disposed within an arcuate slot 97 provided in the cam. During this movement of the cam 93, two pairs of electrical contacts included in the clock mechanism are adapted to be closed in sequence. Each of the two pairs of contacts comprises a follower 98 of any suitable insulating material, which follower is urged into engagement with a cylindrical cam surface 99 provided on the cam 93. The cam surface is provided with a plurality of peripheral indentations 101 and 102 therein, which indentations are adapted to receive the followers 98 and are of varying lengths, thereby to cause the pairs of contacts to close in sequence.

According to the foregoing arrangement, contacts 103 and 104 of the clock mechanism are the first to close whereupon a circuit is closed from a battery BA, arranged as a source of electrical energy, to a condenser 105, this circuit being traced over the following path: positive terminal of battery BA, conductor 106, contacts 103 and 104 of the clock mechanism A, conductor 107, condenser 105, conductor 108, contacts 75 and 65 of the pressure switch, conductor 109 from whence the circuit is completed to the negative terminal of battery BA, thereby charging the condenser 105.

It will be understood that the charging time of condenser 105 is short and that when a full charge obtains on the condenser 105 the current supplied by the battery will flow through the operating magnet OM of relay 116.

As the mine is launched into the water and comes to rest on the bed thereof, the shocks received thereby may cause the armature 111 of relay 87 to be moved into engagement with either of the contacts 112 or 113 thereof, the armature being held in engagement by reason of the soft iron mass 114 formed on the armature 111 and the permanent magnet 120. The armature 115 of relay 116 is normally held in engagement with contact 117 thereof by reason of the soft iron mass 118 and permanent magnet 119 and the spring 121.

As the contacts 103 and 104 of the clock mechanism close, a circuit is also completed from the battery BA to a motor operated cam device generally designated as TD such, for example, as the motor operated cam device described and claimed in the copending application of John F. Toomey et al for Firing Control Mechanism for a Mine, Ser. No. 490,044, filed June 8, 1943. The motor operated cam device is adapted to be operated in unit cycles and comprises means for making and breaking a plurality of circuits in predetermined sequential order and for predetermined periods of time. The circuit closed to the motor operated cam device TD, herein after referred to as a timing device, by the contacts 103 and 104 is traced over the following circuit: positive terminal of battery BA, conductor 106, contacts 103 and 104 of the clock mechanism A, conductor 107, the normally closed contact springs 122 and 123 of the timing device TD, conductor 124, armature 115 and contact 117 of relay 116, conductor 125, contact springs 126 and 127 of the timing device TD, conductor 128, motor M, conductor 109 from whence the circuit is completed to the negative terminal of battery BA, thereby causing motor M to be set in operation.

Shortly after motor M is set in operation, the cam 129 of the timing device causes the contact spring 131 and contact 132 thereof to be moved into engagement with each other, and concurrently therewith contact springs 126 and 127 are disengaged, as are the contact springs 122 and 123. However, by reason of the insulated strip 133, contact spring 123 is moved into engagement with contact spring 134 of the timing device TD. As contact spring 131 moves into engagement with contact 132, the motor M is connected to battery over the following circuit: positive terminal of battery BA, conductor 106, contacts 103 and 104 of the clock mechanism A, conductor 107, contact springs 131 and 132 of the timing device TD, conductor 128, motor M, conductor 109, from whence the circuit is completed to the negative terminal of battery BA whereby the motor M is locked in for a period of time corresponding to the time required by the cam 129 to complete one revolution, such time being constant and predetermined.

Shortly before cam 129 completes one revolution, the cam 135 causes contact spring 136 to move into engagement with contact spring 137 whereby current is caused to flow from the positive terminal of battery through conductor 106, contacts 103 and 104 of the clock mechanism A, conductor 107, reset magnet RM of relay 116, resistor 138, contact springs 137 and 136 of the timing device TD, conductor 109 from whence the circuit is completed to the negative terminal of battery BA. As current flows through the reset magnet RM of relay 116, the armature 115 thereof is disengaged from the contact 117 in a well known manner and is restored to a neutral position whereupon the current flowing through the operating magnet OM of relay 116 exerts a force on the armature and holds it in the neutral position.

Coincident with the flow of current through the reset magnet RM of relay 116, current also flows from the positive terminal of battery BA through conductor 106, contacts 103 and 104 of the clock mechanism A, conductor 107, reset magnet RM of relay 87, resistor 140, contact springs 137 and 136 of timing device TD, conductor 109 from whence the circuit is completed to the negative terminal of battery BA. Current flowing through the reset magnet RM of relay 87 causes the armature 111 thereof to be disengaged from either one of the contacts 112 or 113 thereof and restored to an initial position intermediate the contacts in a well known manner providing, of course, the armature had been jarred into engagement with either of the contacts during the launching of the mine. Otherwise, the current flow through RM has no effect whatsoever if the armature is initially in a position intermediate the contacts.

When the cam 129 completes one revolution, the contact spring 131 is disengaged from the contact 132 and the motor M is disconnected from battery BA, thereby causing the motor M to come to rest and restoring the contact springs associated with the timing device TD to an initial position.

Within a predetermined period of time after contacts 103 and 104 of clock mechanism A have closed which provides a suitable lapse of time after the timing device TD performs the foregoing test cycle, contacts 139 and 141 of the clock mechanism close to connect the negative terminal of the detonator 89 to the negative terminal of battery BA. With the termination of the foregoing cycle of operations, the system of FIG. 8 is now in readiness to respond to the passage of a vessel over the mine.

Let it be assumed by way of example that a vessel having a pressure signature similar to that shown in solid outline in FIG. 6 moves over the mine. Let it further be assumed that before the launching of the mine, the adjustable contact 65 has been adjusted in such a manner to require a predetermined pressure change on the float 71 in order to disengage the contacts of the pressure switch. Shortly after the bow of the vessel moves over the mine, the pressure field adjacent the mine undergoes a reduction in pressure as shown in FIG. 6. When this occurs, the hydraulic system of FIG. 1 detects this reduction in pressure and reacts in a manner heretofore described whereby the contacts 65 and 75 of the pressure switch are disengaged from each other. When this occurs, battery BA no longer supplies current to the operating magnet OM of relay 116. However, when contacts 65 and 75 of the pressure switch are disengaged, the condenser 105 begins to discharge over the following path: positive plate of condenser 105, conductor 107, operating magnet OM of relay 116, resistor 149, resistor 148, conductor 108 and thence to the negative plate of condenser 105, thereby supplying sufficient current through the operating magnet OM of relay 116 to prevent the armature 115 of the relay from moving into engagement with contact 117 thereof. As the contacts of the pressure switch remain open, condenser 105 continues to discharge, the current flowing in the discharge circuit gradually diminishing. If the pressure switch remains open for a predetermined interval as determined by the pressure signature of the vessel, the current in the discharge circuit of condenser 105 will have decreased to a value insufficient to hold the armature 115 of relay 116 against the tension supplied thereto by the spring 121 whereby the armature moves into engagement with the contact 117 and is held in engagement therewith in a manner heretofore described.

When the armature 115 moves into engagement with the contact 117, a circuit is closed from battery BA to the motor M thereby initiating a cycle of operations of the timing device TD and the aforesaid live period of the mine. When the cam 142 has been rotated a short distance, contact springs 143 and 144 are moved into engagement with each other thus connecting the relays 116 and 87 in series with the detonator 89 by way of relay 87, conductor 125, relay 116, conductor 124, contact springs 123 and 134 which closed shortly after motor M was started, conductor 145, contact springs 143 and 144, conductor 146 and thence to the positive terminal of the detonator 89.

If during the live period of the mine the vessel produces a change in the earth's magnetic field and thereby causes an electromotive force to be generated in the search coil 86 sufficient to operate relay 87, the armature 111 thereof moves into engagement with either contact 112 or 113 selectively in accordance with the direction of field change. When relay 87 operates a circuit is closed from the positive terminal of battery BA through conductor 106, contacts 103 and 104 of the clock mechanism A, conductor 107, either contact 112 or 113 of relay 87 and the armature 111 thereof, conductor 125, contact 117 and armature 115 of relay 116, conductor 124, contact springs 123 and 134, conductor 145, contact springs 143 and 144, conductor 146, electro responsive detonator 89, conductor 147, contacts 139 and 141 of the clock mechanism A, conductor 109 and thence to the negative terminal of battery BA, thereby exploding the mine.

In the event, however, a magnetic signal of sufficient strength to operate relay 87 is not received during the cycle of operations of timing device TD and before contacts 136 and 137 close thus determing the live period of the mine, cam 135 of the timing device TD causes contact spring 136 to move into engagement with contact spring 137 thereby causing the armature 115 of relay 116 to be disengaged from contact 117 thereof and to be held therefrom by the current flowing through the operating magnet OM. It will be understood that current flows through the operating magnet OM of relay 116 at this time since the pressure switch will have closed in accordance with the pressure signature received, condenser 105 will have recharged. Thus, when the motor M comes to rest, the system will again be in readiness to respond to another vessel passing over the mine.

In the event a magnetic signal of sufficient strength to operate relay 87 is received first, a circuit is closed from battery BA to motor M, which circuit may be traced over the following path: positive terminal of battery BA, conductor 106, contacts 103 and 104 of the clock mechanism A, conductor 107, relay 87, conductor 125, contact springs 126 and 127, conductor 128, motor M, conductor 109 and thence to the negative terminal of battery BA, thereby starting motor M and initiating a live period of the mine. During the cycle of operations, the timing device performs in the manner described in the foregoing and if the pressure switch opens for a period of time sufficient to discharge condenser 105 a predetermined amount, relay 116 is caused to operate, thereby completing the detonator circuit and exploding the mine. Similarly, if during a cycle of operations of the timing device TD which has been initiated by the magnetic component, the relay 116 associated with the pressure component is not operated, the system of FIG.

8 is restored to its initial condition in a manner heretofore described.

One disadvantage of a pressure controlled mine is the fact that wave action tends to operate the pressure component of the mine spuriously. In the electrical system of the present invention, however, the effects of wave action are substantially overcome by reason of the time delay afforded by the condenser 105 before the relay 116 is caused to operate, such time delay requiring the contacts 65 and 75 of the pressure switch to be opened for a predetermined interval. The pressure switch will be opened by the trough which accompanies some waves but since most waves have troughs which are shorter than the predetermined interval chosen for the time delay, the relay 116 will remain unoperated. In the event waves are produced which have a very long period, the pressure component will respond, the system as a whole will not be actuated, however, unless a magnetic signal is produced in predetermined time spaced relation with respect to the pressure signal.

It should now be apparent that the possibility of causing a firing actuation of the system hereindisclosed through the medium of sweeping apparatus is extremely remote for the reason that it is difficult to produce a device which will simulate a ship's pressure signature and produce the required magnetic signal in predetermined time spaced relation therewith. If such a device was employed, its life is likely to be short since the mine swept thereby will explode beneath the device and completely destroy it. Similarly, a countermining explosion occurring within the vicinity of a mine employing the system of the present invention will not produce a firing actuation of the system due to the relatively short period of the pressure signal produced thereby.

From the foregoing it should now be apparent that a mine firing control system has been provided which is well adapted to fulfill the aforesaid objects of the invention. While the invention has been described with particular reference to an example thereof which gives satisfactory results, it will readily be apparent to those skilled in the art to which the invention appertains, after understanding the invention herein described, that further embodiments, modifications and changes may be made without departing from the spirit and scope thereof, as defined by the claims appended hereto.

The invention herein described and claimed may be manufactured and used by or for the Government of the United States of America without payment of any royalties thereon or therefor.

What is claimed as new and desired to be secured by Letters Patent of the United States is:

1. In a submarine mine, a normally open mine firing circuit, a timing device operable in unit cycles and having means for closing said firing circuit partially during a cycle of operations thereof, and pressure and magnetic responsive means each of which is adapted to either initiate a cycle of operations of said timing device or to complete said firing circuit during a cycle of operations of the timing device selectively in accordance with the sequence of response of said pressure and magnetic means.

2. In a submarine mine, a firing circuit therefor, a pair of switching devices adapted to be operated, a timing device adapted to perform cyclic operations and to be set in operation by said switching devices selectively in accordance with the switching device operated, means individual to said switching devices and responsive to pressure and magnetic changes individual thereto for controlling the operation of the switching devices, and means on said timing device and effective when the timing device operates for closing said firing circuit partially during a cycle of operations thereof.

3. In a submarine mine, a firing circuit therefor, a pair of switching devices adapted to be operated, a timing device adapted to perform cyclic operations and to be set in operation by said switching devices selectively in accordance with the switching device operated, means individual to said switching devices and responsive to pressure and magnetic changes individual thereto for controlling the operation of the switching devices, and means on said timing device and effective when the timing device operates for closing said firing circuit partially during a cycle of operations thereof, said firing circuit being completed by the remaining switching device when the remaining switching device is operated during said cycle of operations of said timing device.

4. In a mine of the character disclosed, a mine firing circuit, means responsive to pressure signals transmitted through the water by a vessel moving within the zone of destructivity of the mine, a timing device operable in unit cycles and having means for closing said firing circuit partially when the timing device operates, means controlled by said pressure responsive means and adapted to initiate a cycle of operations of said timing device when a pressure signal is received by the pressure responsive means, means responsive to changes in the magnetic field adjacent the mine produced as a vessel moves into proximate relation thereto, and means controlled by said magnetic responsive means and adapted to complete said firing circuit when a change in the magnetic field adjacent the mine is produced during a cycle of operations of said timing device.

5. In a mine of the character disclosed, a mine firing circuit, a timing device operable in unit cycles and having means for closing said firing circuit partially when the timing device operates, means responsive to changes in the magnetic field adjacent the mine produced as a vessel moves into proximate relation thereto, means controlled by said magnetic responsive means and adapted to initiate a cycle of operations of said timing device when a change in the magnetic field adjacent the mine is produced, means responsive to pressure signals transmitted through the water by a vessel moving within the zone of destructivity of the mine, and means controlled by said pressure responsive means for completing said firing circuit when a pressure signal is received by the pressure responsive means during a cycle of operations of said timing device.

6. In a mine of the character disclosed adapted to be controlled by the combined effects of changes in the pressure and magnetic fields adjacent thereto, a normally open mine firing circuit, a timing device operable in unit cycles and having means for closing said firing circuit partially during a cycle of operations thereof, a pair of switching devices serially connected in said firing circuit, each of said pair of switching devices being adapted to either initiate the operation of said timing device or to complete said firing circuit during a cycle of operations thereof selectively in accordance with the sequence of changes in said pressure and magnetic fields, time measuring means individual to one of said pair of switching devices and adapted to control the operation thereof, means responsive to changes in a pressure field for controlling said time measuring means, and means individual to the other one of said pair of switching devices and adapted to control the operation thereof in response to changes in a magnetic field.

7. In a submarine mine, a firing circuit therefor, a timing device having means for closing said firing circuit partially for a prescribed interval when the timing device operates, means responsive to changes in a magnetic field, pressure responsive means, a control circuit adapted to be energized when a pressure signal is received by said pressure responsive means, a source of power, and a pair of switching devices, one of said pair of switching devices being associated with said control circuit and controlled thereby, the other of said pair of switching devices being associated with said magnetic responsive means and controlled thereby, each one of said pair of switching devices being adapted to initiate the operation of said timing device from said source of power selectively in accordance with the sequence of response of said pressure and magnetic responsive means.

8. In a mine of the character disclosed, a mine firing circuit, a timing device operable in unit cycles and having means for closing said firing circuit partially when the timing device operates, means for initiating a cycle of operations of said timing device, means responsive to pressure signals transmitted through the surrounding water, integrating means controlled by said pressure responsive means and adapted to render said initiating means effective when a pressure signal of predetermined character is received by the pressure responsive means, means responsive to changes in the magnetic field adjacent the mine, and means controlled by said magnetic responsive means and adapted to complete said firing circuit when a predetermined change in the magnetic field adjacent the mine is produced during a cycle of operations of said timing device.

9. In a mine of the character disclosed, a mine firing circuit, a timing device operable in unit cycles and having means for closing said firing circuit partially when the device operates, means responsive to changes in the magnetic responsive means and adapted to initiate a cycle of operations of said timing device when a predetermined change in the magnetic field adjacent the mine is produced, means responsive to pressure signals transmitted through the surrounding water, means for completing said firing circuit, and integrating means controlled by said pressure responsive means and adapted to render effective said circuit completing means when a pressure signal of predetermined character is received by the pressure responsive means during a cycle of operations of said timing device.

10. In a submarine mine, a normally open mine firing circuit, a timing device operable in unit cycles and having means for closing said firing circuit partially during a cycle of operations thereof, a hydraulic system responsive to pressure changes and comprising, a flexible element adapted to transmit changes in external pressure to the system, spring biased means for providing a reference pressure, a detector mechanism arranged between said flexible element and said reference pressure means and adapted to operate when the external pressure varies a prescribed amount and with prescribed rapidity from said reference pressure, a first switching device controlled by said detector mechanism, magnetic responsive means, a second switching device controlled by said magnetic responsive means, and a source of power, said first and second switching devices each being adapted to either initiate a cycle of operations of said timing device from said source of power or to complete said firing circuit during a cycle of operations of the timing device selectively.

11. In a submarine mine, a hydraulic system responsive to pressure changes and comprising, a flexible element in communication with the surrounding water and adapted to transmit pressure changes therein to the hydraulic system, spring biased means for providing a reference pressure, a detector mechanism disposed between said flexible element and said reference pressure means and adapted to operate when the pressure of the surrounding water varies a prescribed amount and with prescribed rapidity from said refrence pressure, means responsive to changes in the magnetic field adjacent the mine, a pair of switching devices respectively individual to said detector mechanism and said magnetic responsive means and controlled thereby, a mine firing circuit, and means controlled by either of said switches selectively for arming said firing circuit.

12. In a hydraulic system of the character disclosed adapted to be submerged in a body of water, a container enclosing a volume of fluid adapted to be varied in accordance with changes in pressure of the surrounding water, a flexible element mounted at one end of said container and adapted to communicate pressure changes in the water to the fluid encased in said container, a bulkhead mounted in said container and having a metered opening therein for equalizing the static pressure thereon when slow changes in water pressure occur, detecting means arranged within a recessed portion of said bulkhead, said detecting means comprising a float adapted to be moved when predetermined changes in water pressure are produced, a first electrical contact member mounted on said float, a pressure responsive device secured to said bulkhead and operable on changes in the static pressure head on the bulkhead, a pivotally mounted arm having one end thereof fastened to said pressure responsive device, and a second electrical contact carried by said arm and normally held thereby in engagement with said first electrical contact whereby the pressure between the contacts is dependent upon the static pressure on said bulkhead.

13. In a submarine mine, a hydraulic system responsive to pressure changes and comprising, a flexible element in communication with the surrounding water and adapted to transmit pressure changes therein to the hydraulic system, spring biased means for providing a reference pressure, a detector mechanism disposed between said flexible element and said reference pressure means and adapted to operate when the pressure of the surrounding water varies a prescribed amount and with prescribed rapidity from said reference pressure, a switching device controlled by said detector mechanism, a mine firing circuit, and means controlled by said switching device for arming said firing circuit for a predetermined interval.

14. In a submarine mine adapted to be armed by a pressure signal of predetermined character, a hydraulic system responsive to pressure changes and comprising, a flexible element in communication with the surrounding water and adapted to transmit pressure changes therein to the hydraulic system, spring biased means for providing a reference pressure, a detector mechanism disposed between said flexible element and said reference pressure means and adapted to operate when the pressure of the surrounding water varies a prescribed amount and with prescribed rapidity from said reference pressure, time integrating means controlled by said detector mechanism, a mine firing circuit, a switching device adapted to be operated by said integrating means when said detector mechanism is maintained operated for a predetermined interval, and means effective when said switching device is operated for arming said firing circuit for a predetermined interval.

15. In a mine of the character disclosed, a mine firing circuit, a timing device operable in unit cycles and having means for closing said firing circuit partially when the timing device operates, means for initiating a cycle of operations of said timing device, means responsive to pressure signals transmitted through the surrounding water from a vessel moving within the vicinity of the mine, and integrating means controlled by said pressure responsive means and adapted to render said initiating means effective when a pressure signal of predetermined character is received by the pressure responsive means.

16. In a mine of the character disclosed, a mine firing circuit, a timing device operable in unit cycles and having means for closing said firing circuit partially when the timing device operates, means for initiating a cycle of operation of said timing device, means responsive to pressure signals transmitted through the water by a vessel moving within the zone of destructivity of the mine, and means controlled by said pressure responsive means for completing said firing circuit when a pressure signal is received by the pressure responsive means during the cycle of operation of said timing device.

* * * * *